US006296121B1

(12) United States Patent
Hershey

(10) Patent No.: US 6,296,121 B1
(45) Date of Patent: Oct. 2, 2001

(54) SEPARATION UNIT FOR SHIPPING CARTON

(75) Inventor: Karl Hershey, Liverpool, NY (US)

(73) Assignee: Pass & Seymour, Inc., Syracuse, NY (US)

( * ) Notice: Subject to any disclaimer, the term of this patent is extended or adjusted under 35 U.S.C. 154(b) by 0 days.

(21) Appl. No.: 09/466,249

(22) Filed: Dec. 17, 1999

(51) Int. Cl.[7] ..... B65D 85/00

(52) U.S. Cl. ..... 206/701; 206/459.5; 229/120.21; 229/118

(58) Field of Search ..... 206/459.5, 701, 206/736, 756, 702; 229/120.01, 120.18, 120.32, 118, 237, 120.06

(56) References Cited

U.S. PATENT DOCUMENTS 3,089,631 * 5/1963 Tyrseck et al. ..... 229/120.01
3,237,842 * 3/1966 Esse ..... 229/118
3,642,125 * 2/1972 Johnson ..... 229/120.21
3,708,104 * 1/1973 Buttery ..... 229/118
4,498,420 * 2/1985 Botterman et al. ..... 206/527
4,860,886 * 8/1989 Northrup et al. ..... 206/459.5
5,049,710 * 9/1991 Prosise et al. ..... 426/107
6,079,563 * 6/2000 Katchmazenski ..... 206/583

* cited by examiner

*Primary Examiner*—Shian Luong
(74) *Attorney, Agent, or Firm*—Wall Marjama & Bilinski

(57) ABSTRACT

A packaging box, and in particular a unitary package for a plurality of electrical wiring devices which also provides integral but detachable instruction cards. The detachable cards are at least as numerous as the devices, and each card is only removed along with a corresponding device. Therefore, the box always has a card for any remaining device.

20 Claims, 7 Drawing Sheets

SEPARATION UNIT FOR SHIPPING CARTON

FIELD OF THE INVENTION

This invention pertains to the packaging of electrical fixtures, and in particular to a unitary package for a plurality of electrical fixtures which also provides a separable instruction card for each fixture.

BACKGROUND OF THE INVENTION

In providing electrical wiring devices such as switches, duplex receptacles and GCFI fixtures, it is frequently convenient to package them in quantities of two or more which an installer may require in a construction or remodeling project. Typically, a package may contain ten such devices. It is a UL code requirement that each device must have its own separate set of instructions. In the past, the instructions have been included as one or more separate sheets of paper for each device which had to be accommodated in the package itself.

Even when separate instructions are provided for each device, it sometimes occurs that several sets of instructions may be removed from the package at one time, leaving an insufficient number of sets in the box for the remaining devices. If considerable time elapses between the installation of one device and the next, the instructions may be mislaid, or an installer using a package previously opened by another installer may not be aware of their whereabouts.

This is clearly an inconvenience. For this reason and also for reasons of economy and to conserve space, it would be useful to provide a package wherein these problems are alleviated.

SUMMARY OF THE INVENTION

The present invention provides an integral packaging box for a plurality of electrical devices. The package has flaps, each attached to the top of a corresponding side wall or end wall, and each having a plurality of perforations or other lines of weakness dividing the flap into separate areas. The areas can be intentionally detached as required, one or more at a time. Preferably, each area includes indicia comprising full instructions for a device, and there is at least one such area per device. As a device is removed from the box, one detachable area can be torn off at a perforation to provide an instruction card for that device. This not only ensures that the required codes are observed, but guarantees that, unless there is deliberate misuse or unlikely error, there are always instructions available for every device as it is removed from the package.

As well as providing for sufficient copies of the instructions, the flaps can either provide a platform above one row of devices for receiving another row of devices, or they function as dust flaps to protect the contents of the package. The lines of weakness are placed consistently with the required positions of folds in the overall package.

DETAILED DESCRIPTION OF THE PREFERRED EMBODIMENT

The packaging box of the invention accepts a plurality of electrical wiring devices, and has integral to it a separate set of detachable instructions for each device. With each device that is removed for installation, a set of instructions can be detached, leaving sufficient copies for the remaining devices.

Figure 1:
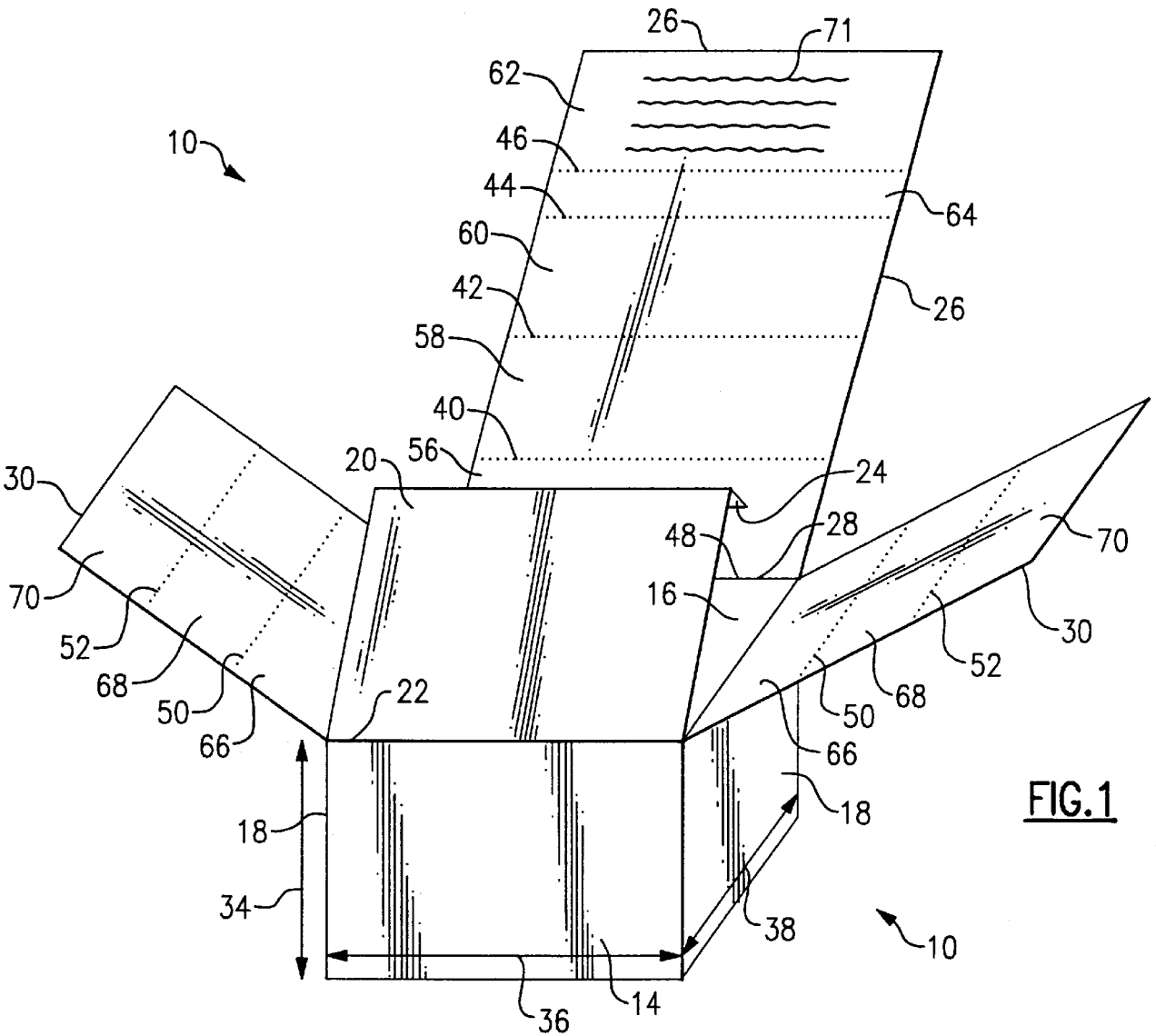
FIG. 1 is a perspective view of a packaging box.
Figure 2:
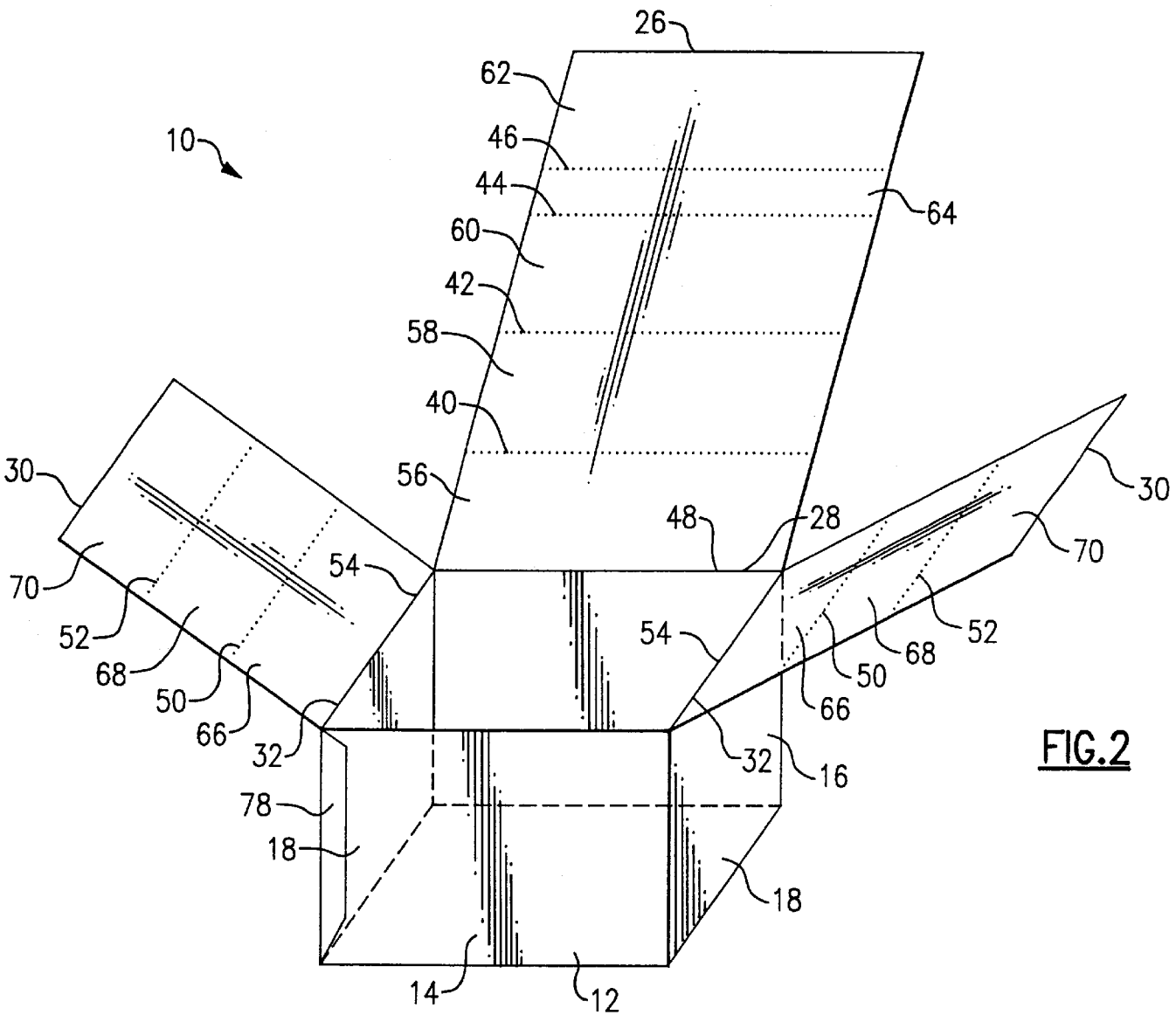
FIG. 2 is a simplified perspective view of the box.

In the example shown in FIGS. 1 and 2, the packaging box 10 is intended to accept ten devices, although the invention is clearly adaptable to a greater or lesser number of devices.

The box 10 has a base 12, a front side 14, an opposing rear side 16, two opposing ends 18, and a cover 20 which is omitted from FIG. 2 for clarity. The cover 20 is foldably attached to the front side 14 along a top edge 22, and has a tuck-in flap 24. The box 10 also has a side flap 26, foldably attached to the rear side 16 along a top edge 28, and two end flaps 30 foldably attached to the ends 18 at upper edges 32.

FIG. 1 shows the height 34, length 36 and width 38 of the package. The side flap 26 has parallel lines of weakness or score lines or impressions or other means to provide lines of weakness 40, 42, 44 and 46 which are shown in FIG. 1 as dotted lines. A further line of weakness 48 coincides with the fold at the upper edge 28 where the rear side 16 and the side flap 26 meet. The end flaps 30 also have parallel lines of weakness 50 and 52 along the dotted lines and additionally 54 along the folds at the upper edges 32 where the ends 18 and the end flaps 30 meet. The lines of weakness of the side flap 26 allow the separation, when desired, of first, second, third and fourth detachable major areas, 56, 58, 60 and 62 respectively, and of an extending minor area 64, which lies between major areas 60 and 62. The lines of weakness of each end flap 30 provide for the separation of a first, second and third major area 66, 68 and 70 respectively, thus providing a total of ten detachable major areas. Each major area has indicia printed thereon, providing a set of instructions pertaining to the installation and use of the wiring device. Lines of weakness which do not coincide with folds are shown as dotted lines in all the drawings except FIG. 3.

Figure 3:
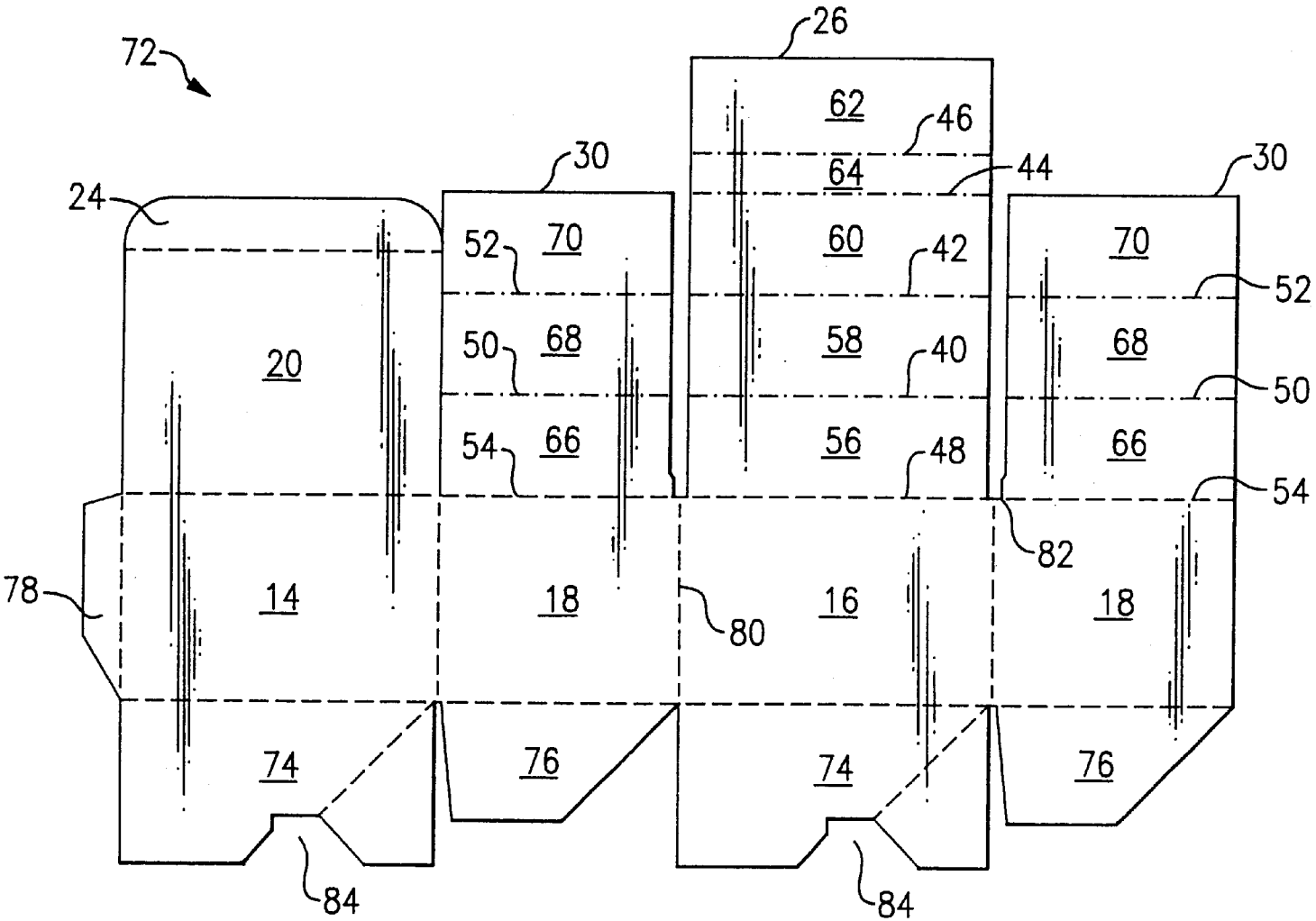
FIG. 3 is a plan view of a blank from which the box is made.

FIG. 3 shows a one-piece blank 72 made of paperboard, cardboard or other suitable material from which the packaging box 10 is to be formed. The blank 72 of FIG. 3 comprises a plurality of surface portions intended to form the base, opposed sides, opposed ends, end flaps, side flap and cover for the box. All areas of FIG. 3 which appear in other drawings are correspondingly labelled, except for the base 12, which comprises two major base members 74 and two minor base members 76. FIG. 3 also shows an attachment flap 78 foldably joined to the portion which forms the front side 14, along an intended vertical edge of the front side 14. In FIG. 3, the lines comprising alternate dots and dashes represent lines of weakness. The uniform dashed lines of FIG. 3 are fold lines such as 80 and 82 which are necessary to the structure of package 10 as shown in FIG. 1, or to an intermediate structure. The fold line 82 coincides with lines of weakness where it bounds the intended side flap 26 and end flaps 30.

As shown in FIG. 3, the side flap 26 and end flaps 30, which are disposed to either side of the side flap, all extend in the same direction from the fold line 82. The lines of weakness lie perpendicularly to the direction in which the flaps extend. Within the distance to which the end flaps extend, each perforation in a given flap is commonly aligned with a perforation in a neighboring flap. For example, both of the end flap lines of weakness 50 and the side flap line of weakness 40 have a common alignment. This facilitates the manufacture of the blank.

The aforementioned intermediate structure results from partially assembling the blank 72 to a more compact collapsed form in which it is received ready for use by the packager. The blank 72 is folded about the fold line 80 so that the sections on either side of the fold line 80 have their intended inside surfaces facing each other. The attachment flap 78 is glued to the inside surface of the portion which forms the front side 14. The major base members 74 are each glued to the corresponding minor base member 76 to form two opposed base portions, When the collapsed form is opened up to assemble the box, the base portions interlock at notches 84 to form the base 12 which has considerable rigidity, and holds the package securely in open in the conformation substantially shown in FIG. 1. The manner in which the box 10 is put together up to this point is not a part of this invention and, being well known in the art, requires no further detail.

Figure 4:
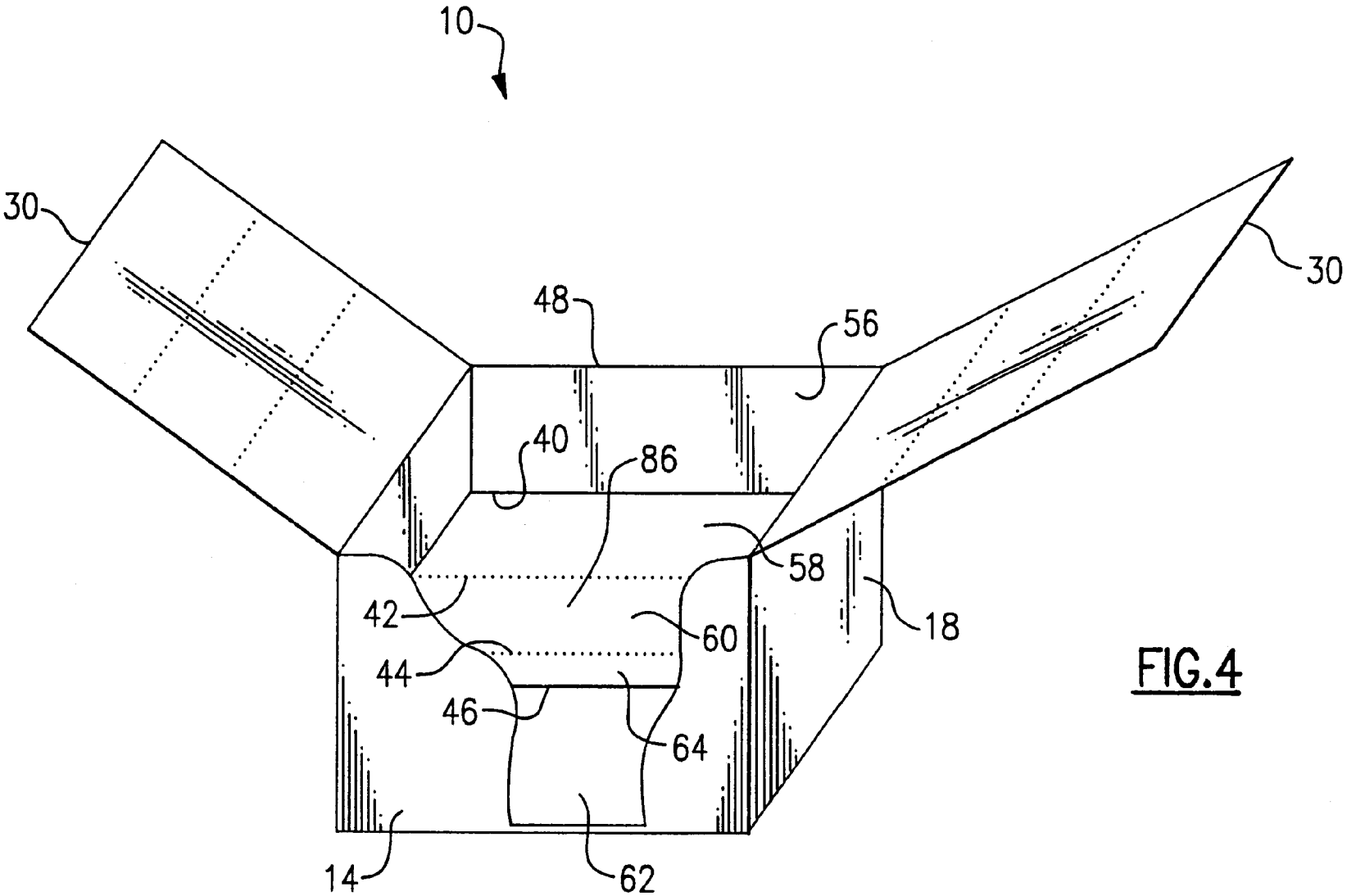
FIGS. 4, 5 and 6 are cutaway perspective views of the box in various stages of use.

In FIGS. 1 and 2, the packaging box 10 is ready to receive a lower row of devices which will rest on the base and fill the lower half of the box. FIG. 4 shows a cutaway view of the box 10 in a further stage of assembly. It is assumed that the lower row of devices (not shown) has been packed in the bottom of the box 10.

The lines of weakness in the side flap 26 are spaced apart so that all of its detachable major areas have an equal width, which is equivalent to half the height 34 of the box 10. In FIG. 4, the side flap 26 has been inwardly folded at its join with the rear side 16, which coincides with the perforation 48, until its first major area 56 lies against the rear side 16. At the perforation 40 between the first and second major areas 56 and 58, the side flap 26 is folded to dispose the second and third major areas 58 and 60 and the minor area 64 horizontally across the box 10. The side flap 26 is further folded at the perforation 46 between the minor area 64 and the fourth major area 62 so that the fourth major area 62 extends downwardly to the base 12 of the box 10 against the inside of the front side 14.

In other words, a portion of the side flap 26 comprising the second and third major areas 58 and 60 and the minor area 64 acts as a horizontal platform 86 covering the lower row of devices, and a further portion comprising the major area 62 tucks in between the devices and the front side 14. The minor area 64 is sized to make the platform 86 correspond with the width 38 of the box.

Figure 5:
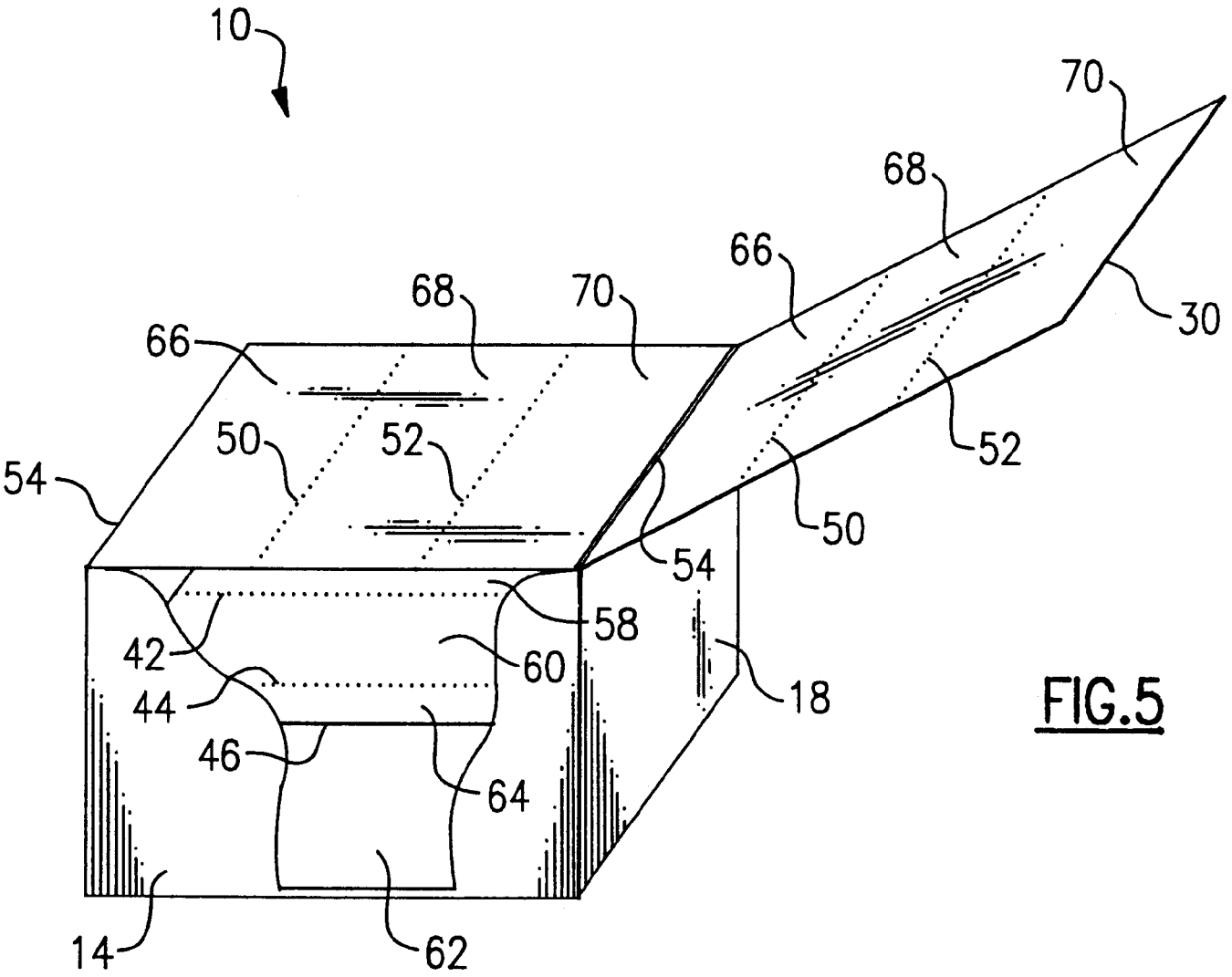
Figure 6:
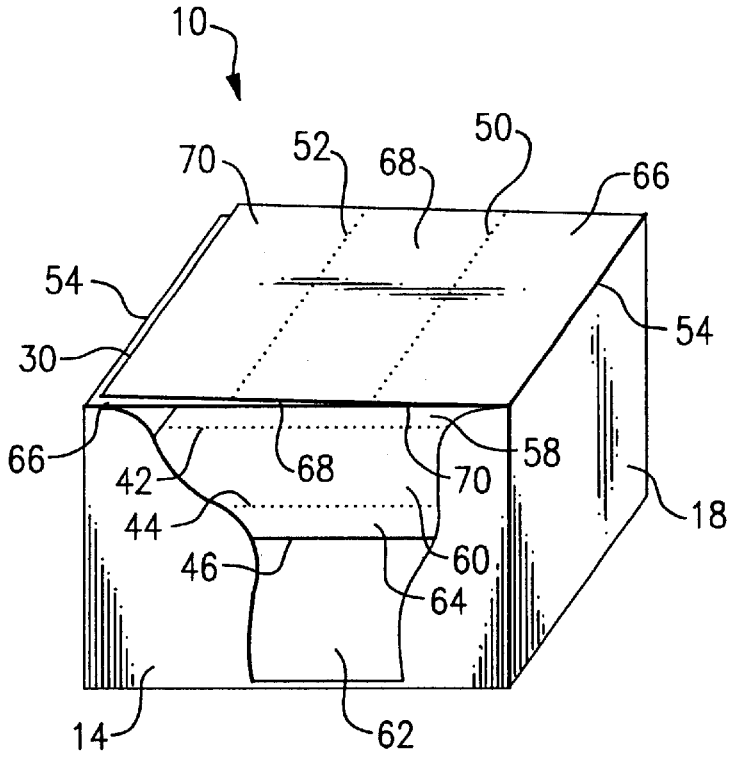
Figure 7:
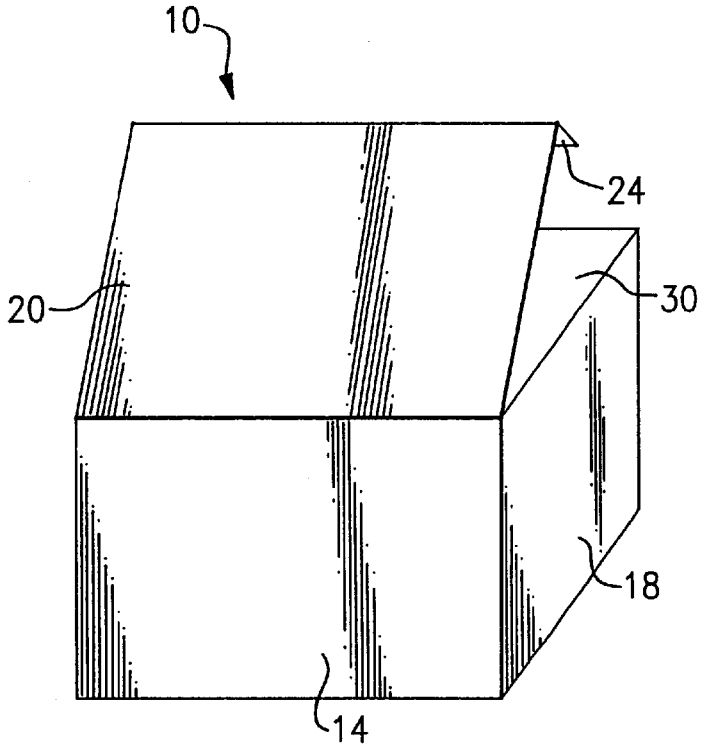
FIG. 7 is a perspective view of the box when ready to be closed.

An upper row of devices can now be stacked atop the platform 86. For clarity, the devices are not shown, but the cutaway FIG. 5 show how one of the end flaps 30 would be folded down at its join with the corresponding end 18 to be disposed atop the upper row of devices. Cutaway FIG. 6 then shows the second end flap 30 similarly folded down to be disposed atop the first end flap 30. The end flaps 30 act similarly to dust flaps in conventional packages, but additionally provide the detachable areas, each of which bears the instructions necessary for the installation and operation of a device. Finally, FIG. 7 shows the packaging box 10 ready to be closed by inserting the tuck-in flap 24 within the rear side 16.

When devices are to be installed, the package is opened, a first device is removed, and the third major area 70, bearing instructions, is detached from one of the end flaps 30, both of which are accessible. With the installation of succeeding devices, further major areas are detached in turn from the remaining end of the end flap 30. When all of the upper row of devices have been used, the side flap 26 is opened to expose the lower row, and the major areas therefrom used as necessary. The minor area 64 serves only to provide that the platform 86 can extend the full width of the box 10, allowing the major detachable area 62 to then be folded down at the perforation 46, and it can be discarded accordingly.

Figure 8A:
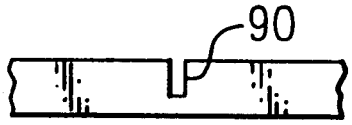
FIG. 8A is a partial cross sectional view taken across the width of an incision showing the incision that does not penetrate the entire thickness of the packaging material.
Figure 8B:
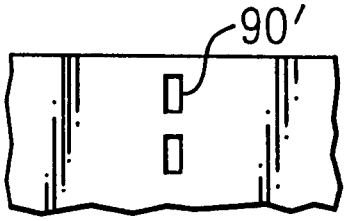
FIG. 8B is a partial top view showing continuous incisions that penetrate the entire thickness of the packaging material.
Figure 8C:
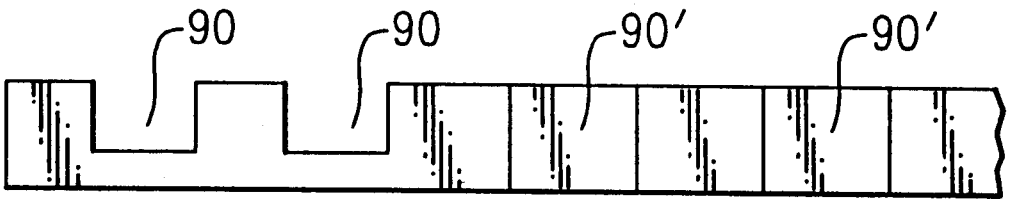
FIG. 8C is a partial cross sectional view taken across the lenght of several incisions showing incisions that do not penetrate the entire thickness of the packaging material near an extremity of a line of weakness, and showing incisions away from the extremity of the line of weakness that penetrate the entire thickness of the packaging material.

Referring to FIGS. 8A–8C, a line of weakness in the packaging box 10 may be in the form of intermittent incisions 90' or lines of weakness which penetrate the entire thickness of the packaging material, or in the form of a continuous incision 90 into the packaging material which does not extend through the thickness of the material, or any selected combination or variation thereof.

Barring deliberate misuse of the package, or the unlikely event that too many major areas are detached in error, the box 10 always retains a major area bearing instructions for each device remaining therein. This is particularly important when a box 10 is re-used after a period of storage, or if it is used by an installer other than the one who originally opened the package. With prior art, originally separate instruction sheets may be lost or mislaid, or their whereabouts may be known only to the original installer.

While the invention has been described with reference to preferred embodiments, it will be understood by those skilled in the art that various changes may be made and equivalents may be substituted for elements thereof without departing from the scope of the invention. In addition, many modifications may be made to adapt a particular situation of material to the teachings of the invention without departing from the scope of the invention. Therefore, it is intended that the invention not be limited to the particular embodiments disclosed as the best mode contemplated for carrying out this invention, but that the invention will include all embodiments falling within the scope and spirit of the appended claims.

What is claimed:

1. A packaging box for a plurality of electrical wiring devices, the box having a base, two opposing sides, two opposing ends, and a cover foldably attached to one of the sides along a top edge thereof, and further comprising:

a side flap having a plurality of lines of weakness, and foldably attached at one of said lines of weakness to a top edge of the side opposite the cover, the lines of weakness defining a first plurality of intentionally detachable major areas; and two end flaps, each having a plurality of lines of weakness and each foldably attached at one of said lines of weakness to a top edge of a corresponding end, the lines of weakness of each flap defining a second plurality of intentionally detachable major areas;

wherein a total number of said first and second pluralities of the major areas equal or exceed a number of electrical wiring devices to be packed in said box.

2. The packaging box of claim 1, wherein at least one of the flaps has the capability of being folded at lines of weakness to form a platform which is sized to rest on a lower row of devices and act a support for an upper row of devices.

3. The packaging box of claim 2, wherein each of the major areas has printed indicia pertaining to a wiring device.

4. A packaging box for a plurality of electrical wiring devices, the box having a base, two opposing sides, two opposing ends, and a cover foldably attached to one of the sides along a top edge thereof, and further comprising:

a side flap having a plurality of parallel lines of weakness, and foldably attached at one of said lines of weakness to a top edge of the side opposite the cover, the lines of weakness defining a first plurality of rectangular major areas which are intentionally detachable; and two end flaps, each having a plurality of lines of weakness and each foldably attached at one of said lines of weakness to a top edge of a corresponding end, the lines of weakness of each flap defining a second plurality of rectangular major areas which are intentionally detachable;

wherein a total number of said first and second pluralities of the major areas equal or exceed a number of electrical devices to be packed in the box, and at least one of the flaps has the capability of being folded at lines of weakness to form a platform which is sized to rest on a lower row of devices and act as a support for an upper row of devices.

5. The packaging box of claim 4, wherein each of the major areas has a dimension equal to half the height of the box.

6. The packaging box of claim 4, wherein each of the major areas has printed indicia pertaining to the devices.

7. The packaging box of claim 4, wherein the platform comprises an integral number of major areas.

8. The packaging box of claim 7, wherein the platform further comprises an extending minor area which also is intentionally detachable at a line of weakness.

9. The packaging box of claim 4, wherein the lines of weakness comprise intermittent incisions which penetrate the entire thickness of the packaging material.

10. The packaging box of claim 4, wherein the lines of weakness comprise continuous incisions which do not penetrate the entire thickness of the packaging material.

11. The packaging box of claim 4, wherein the lines of weakness comprise continuous incisions which penetrate the entire thickness of the packaging material except at the extremities of the lines of weakness.

12. A one-piece blank for producing a packaging box which has a length, a width and a height, for a plurality of electrical wiring devices, the blank comprising a plurality of surface portions intended to form a base, opposed sides, opposed ends, and a cover for the box, a plurality of fold lines interconnecting the surface portions, and further comprising:

a side flap foldably attached at a line of weakness to a portion of the blank intended to form a side of the box, the attachment being along an edge intended to be a top edge of the side, the side flap having at least one further line of weakness aligned parallel to its first line of weakness, and having a first plurality of rectangular major areas which are intentionally detachable at the lines of weakness; and two end flaps, each foldably attached at a line of weakness to a portion of the blank intended to form a corresponding end of the box, the attachment being along an intended top edge of the end, each end flap having at least one further line of weakness aligned parallel to its first line of weakness, and having a second plurality of rectangular major areas which are intentionally detachable at the lines of weakness;

wherein a total number of said first and second pluralities of the major areas equal or exceed a number of electrical devices to be packed in the box, and at least one of the flaps has the capability of being folded at lines of weakness to form a platform which is sized to rest on a lower row of devices and act as a support for an upper row of devices.

13. The blank of claim 12, wherein each of the major areas has a dimension equal to half the intended height of the box.

14. The blank of claim 12, wherein each of the major areas has printed indicia pertaining to the devices.

15. The blank of claim 12, wherein the platform comprises an integral number of major areas.

16. The blank of claim 15, wherein the platform further comprises an extending minor area which also is intentionally detachable at a line of weakness.

17. The blank of claim 12, wherein the end flaps and the side flap extend from a common fold line in the same direction with the side flap extending beyond the end flaps, the lines of weakness are perpendicular to this direction, and each line of weakness within the distance to which the end flaps extend has a common linear alignment with a line of weakness in an adjacent flap.

18. The blank of claim 12, wherein the lines of weakness comprise intermittent incisions which penetrate the entire thickness of the packaging material.

19. The blank of claim 12, wherein the lines of weakness comprise continuous incisions which do not penetrate the entire thickness of the packaging material.

20. The blank of claim 12, wherein the lines of weakness comprise continuous incisions which penetrate the entire thickness of the packaging material except at the extremities of the lines of weakness.

* * * * *